US005748432A

United States Patent [19]

Przywozny et al.

[11] Patent Number: 5,748,432

[45] Date of Patent: May 5, 1998

[54] METHOD AND APPARATUS FOR PREVENTING COIL INDUCED DELAY IN A AUTOMATIC TRANSFER SWITCH

[75] Inventors: Walter Przywozny, Whippany; Daniel Scheffer, Boonton, both of N.J.

[73] Assignee: Automatic Switch Company, Florham Park, N.J.

[21] Appl. No.: 727,245

[22] Filed: Oct. 9, 1996

[51] Int. Cl.[6] ..... H01H 47/00

[52] U.S. Cl. ..... 361/159

[58] Field of Search ..... 361/152, 159, 361/154–156

[56] References Cited

U.S. PATENT DOCUMENTS 4,458,290 7/1984 Miyashita ..... 361/152

4,949,215 8/1990 Studtmann et al. ..... 361/154

*Primary Examiner*—Ronald W. Leja

*Attorney, Agent, or Firm*—Levine & Mandelbaum

[57] ABSTRACT

An automatic transfer switch for transferring a load between a normal power source and an alternate power source has a control circuit which senses the movement of the plunger of the switch-actuating solenoid into a position proximate the plunger stop or pole piece and then turns off power to the coil current so that the plunger can be restored to its rest position as the inertia of the switch enables completion of the transfer. Upon interruption of voltage to the coil, the coil is switched in series with a resistance which rapidly dissipates the residual current generated by the collapsing field within the coil to alleviate the braking effect of the residual coil current on the solenoid plunger.

9 Claims, 2 Drawing Sheets

COIL CONTROL CIRCUIT

METHOD AND APPARATUS FOR PREVENTING COIL INDUCED DELAY IN A AUTOMATIC TRANSFER SWITCH

BACKGROUND OF THE INVENTION

This invention relates to the enhancement of the switching speed of an automatic transfer switch. More specifically, the invention is directed to a method of, and the construction of apparatus for, preventing delay in the switching of a solenoid operated automatic transfer switch due to residual coil current in the actuating solenoid.

It is known in the art to employ an automatic transfer switch in an environment where even a very brief power outage can be very harmful, e.g. in hospitals and manufacturing plants. Automatic transfer switches are operated by control systems which sense an interruption in the supply of normal power to a load, e.g., from a utility company, and actuate the automatic transfer switch to supply power to the load from an alternate source, e.g., a local generator. It is also known to employ inertia driven automatic transfer switches having an armature consisting of a weight mounted on and rotatable with a shaft on which there is also mounted one or more movable contacts, or cams operatively connected to the switch contacts, for opening and closing the contacts in response to rotation of the armature. It is further known to couple an eccentric point on the armature to the plunger of a solenoid by a pivotal link for actuating the automatic transfer switch by converting the linear force exerted by the solenoid pole piece on the plunger to torque applied to the armature in order to commence rotation of the armature for opening and closing the normal and alternate contacts.

In the aforementioned prior art automatic transfer switches, the coil of the solenoid is normally connected to the alternate power source and energized upon an interruption in the supply of power from the normal source. In response to the energization of the coil, the solenoid plunger is drawn from its rest position at one end of a channel in the solenoid housing, inwardly against the opposing force of a coil return spring, toward a ferromagnetic pole piece surrounded by the coil at the opposite end of the channel. The pole piece may act as a stop for the plunger or a separate stop may be provided which is engaged by the plunger before it reaches the pole piece. In the preferred embodiment of the invention, the stop and pole piece may be one and the same and the terms "stop" and "pole piece" are hereinafter used interchangeably.

The solenoid and armature are normally dimensioned and connected so that when the plunger reaches its extreme inward position within the coil, adjacent the stop, the link is in axial alignment with the plunger and center of rotation of the armature. At this point, the voltage that has been applied to the solenoid coil is interrupted, and the inertia of the weight causes rotation of the armature past "top dead center", aided by the force of the coil return spring. The rotation of the armature continues until the solenoid plunger returns to its rest position whereat the normal source contacts are opened and the alternate source contacts are closed thereby completing the transfer of the load to the alternate source of power.

In prior art automatic transfer switches of the foregoing type, the stored energy remaining in the solenoid coil, after disconnection of solenoid actuating voltage, induces an electromotive force in the coil whereby the coil current continues to attract the solenoid plunger toward the stop against the momentum of the weight and the opposing force of the coil return spring, thereby delaying the return of the plunger to its rest position and the completion of the rotation of the armature to its position at which the alternate contacts are engaged.

SUMMARY OF THE INVENTION

The aforementioned problems of the prior art are overcome by the instant invention which provides for an automatic transfer switch for disconnecting a load from one of a normal source of power and an alternate source of power and connecting the load to the other of the normal source of power and alternate source of power without delay due to residual coil current. The automatic transfer switch has a set of normal source contacts, a set of alternate source contacts, an armature including main contacts engageable with the set of normal source contacts and set of alternate source contacts and movable between a normal position at which the armature closes the normal source contacts and opens the alternate source contacts, and an alternate position at which the armature closes the alternate source contacts and opens the normal source contacts.

A solenoid has a plunger connected to the armature. The plunger is reciprocable in the housing of the solenoid for movement toward and away from a stop surrounded by the coil in response to the application and interruption of source voltage to the coil for commencing movement of the rotating armature from one of the normal and alternate positions toward the other of the normal and alternate positions. A coil voltage switch is actuated in response to the position of the plunger to interrupt the application of voltage to the coil just before the plunger reaches the stop.

The armature has an actuator for actuating a coil voltage switch to interrupt the application of voltage to the coil as the armature is rotated to a predetermined position corresponding to the approach of the plunger to the solenoid stop. The disconnection of source voltage to the coil is sensed and the residual coil current is shunted through a current dissipation device such as a metal oxide varistor. The momentum of the armature is then free to continue its movement to the other of the normal and alternate positions free of the force of the collapsing field in the coil.

It is therefore an object of the invention to provide a method and apparatus for preventing delay in the switching of a solenoid operated automatic transfer switch due to residual coil current in the actuating solenoid.

Another object of the invention is to provide a method and apparatus for detecting interruption of voltage applied to the solenoid coil and dissipating the residual coil current to prevent delay in completion of the switching of the solenoid operated automatic transfer switch.

Still another object of the invention is to provide a method and apparatus for dissipating the residual current flow in the coil of an automatic transfer switch to prevent delay in switching.

Other and further objects of the invention will be apparent from the following drawings and description of a preferred embodiment of the invention in which like reference numerals are used to indicate like parts in the various views.

DESCRIPTION OF THE PREFERRED EMBODIMENT

Figure 1C:
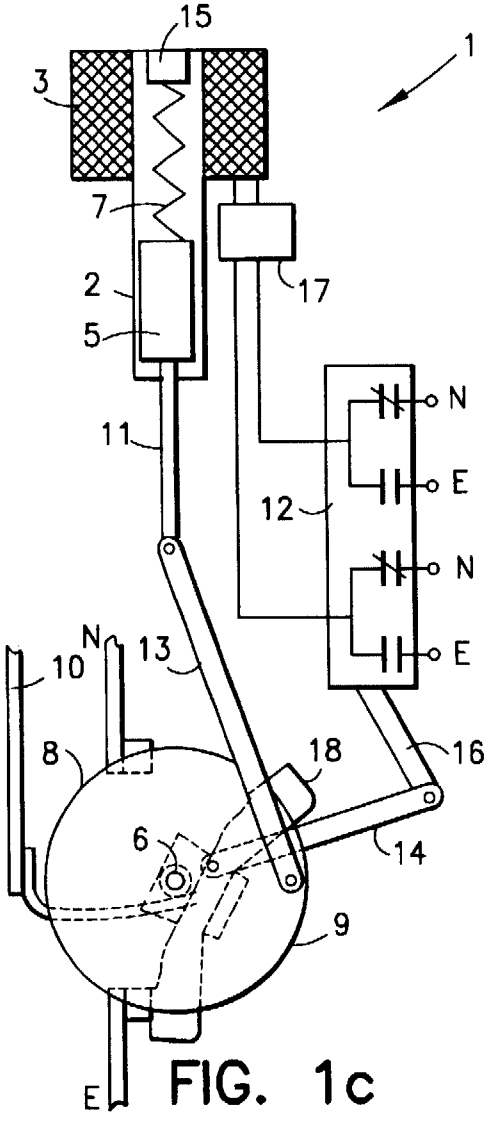
FIG. 1*c* is a mechanical schematic view illustrating the preferred embodiment of the invention in a third state.
Figure 1B:
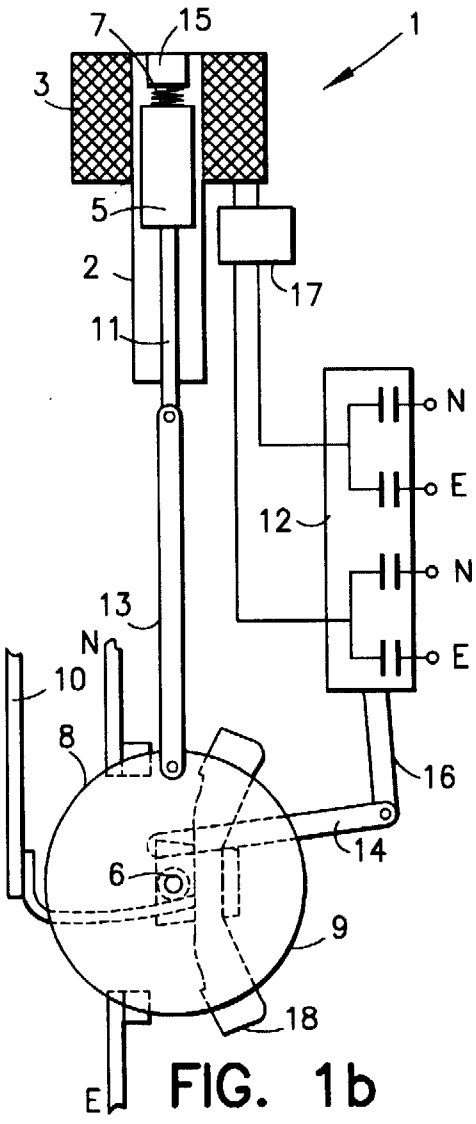
FIG. 1*b* is a mechanical schematic view illustrating the preferred embodiment of the invention in a second state.
Figure 1A:
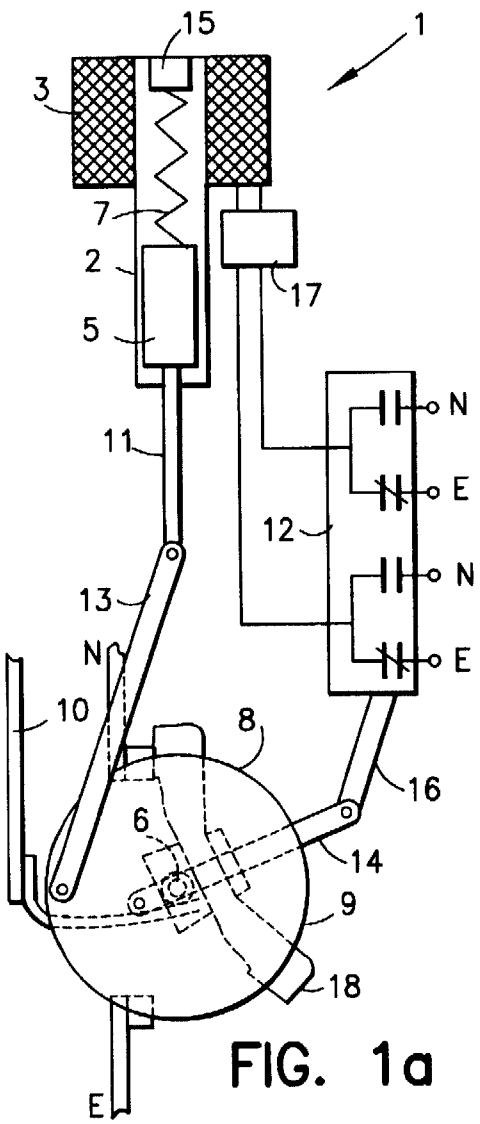
FIG. 1*a* is a mechanical schematic view illustrating the preferred embodiment of the invention in a first state.

Referring now to FIGS. 1*a*, *b*, and *c* of the drawings, there is schematically shown an automatic transfer switch 1 in three of its dispositions. In FIG. 1*a*, the automatic transfer switch 1 has its main contacts connected to the normal source of power N, i.e., to connect a load 10 to the normal source of power which is typically the service provided by an electric utility company. In the event of a power failure or substantial interruption of power from the normal source, the automatic transfer switch 1 is actuated to transfer the load from the normal power source N to an alternate power source E by disconnecting the main contacts from the normal power source N and connecting the main contacts to the alternate source E.

The automatic transfer switch control system circuitry (not shown), senses the interruption of power from the normal source and turns on the alternate source which begins to apply its voltage at contacts E to a coil control circuit 17, thereby drawing the solenoid plunger 5 inwardly from its rest position toward a pole piece or stop 15 which is surrounded by the coil 3. The force exerted by the pole piece 15 on the solenoid plunger 5 is greater than the opposing force of a return spring 7 on the plunger 5. Accordingly, a disc-shaped weight 8 which is mounted on a shaft 6 to form part of an armature 9 of the transfer switch 1 is pulled by a link 13 pivotally connected to a rod 11 extending from the plunger 5 to cause clockwise rotation of the armature 9 in the views of FIGS. 1*a*, *b*, and *c*. Also mounted on the shaft 6 are moveable contacts 18 (one of which can be seen in FIGS. 1*a*, *b*, *c*) which are rotatable with the shaft 6 for transferring the load 10 between the normal power source N (FIG. 1*a*) and the alternate power source E (FIG. 1*c*).

The plunger 5 is drawn inwardly in response to the electromagnetic force of the pole piece 15 caused by the coil current until the plunger 5 is almost in engagement with the plunger stop 15 (FIG. 1*b*). At this time the armature 9 has rotated almost to top dead center where the disc link 13 is in axial alignment with the solenoid plunger 5, solenoid plunger rod 11, and axis of rotation of the armature 9, including the shaft 6 and weight 8. In this position, application of voltage from the alternate source E to the solenoid coil 3 is interrupted by the actuation of switch contacts 12 of a coil voltage switch having a control arm 16 which is pivotally connected to one end of a link 14, the other end of which is rotatably mounted on the armature 9.

The switch contacts 12 are connected to the arm 16. When the arm 16 is in the leftmost position as shown in FIG. 1*a*, the switch contacts 12 connect the coil control circuit 17 to the alternate source of power E. When the arm 16 is in the intermediate position as shown in FIG. 1*b*, the switch contacts 12 do not connect the coil control circuit 17 to the normal source of power N or the alternate source of power E. When the arm 16 is in the rightmost position as shown in FIG. 1*c*, the switch contacts 12 connect the coil control circuit 17 to the normal source of power E.

The switching arrangement is such that when the load 10 is connected to draw power from the normal source contacts N (FIG. 1*a*), the coil control circuit 17 draws power for the solenoid coil from the alternate source contacts E. Conversely, when the load is connected to draw power from the alternate source contacts E, the coil control circuit 17 draws power for the solenoid coil 3 from the normal source contacts N (FIG. 1*c*).

Figure 2:
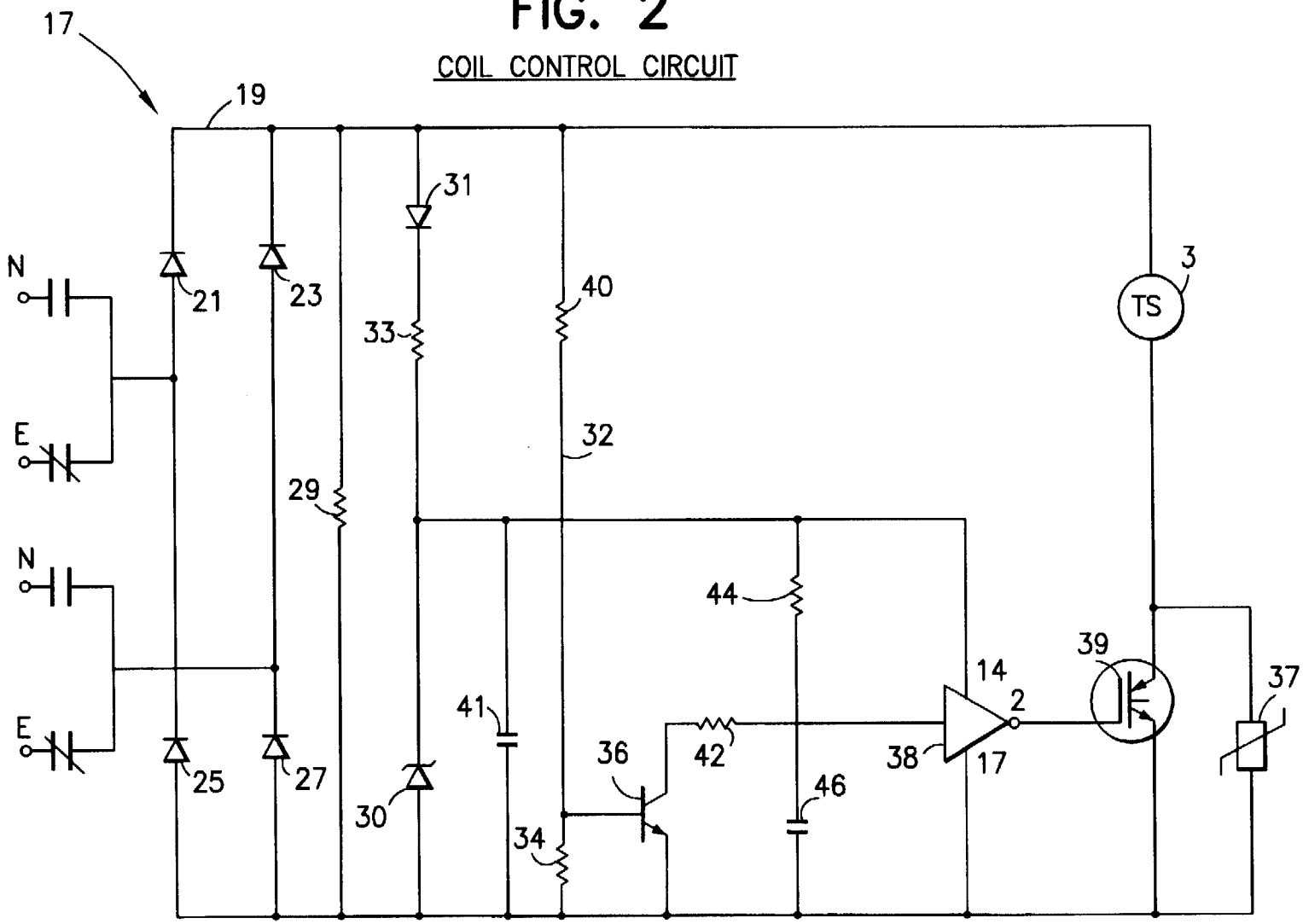
FIG. 2 is an electrical circuit schematic view of the apparatus of the preferred embodiment of the invention.

Referring now to FIG. 2 of the drawings, during application of normal power to the load 10, the load 10 is connected by the transfer switch 1 to the normal source contacts N. The solenoid coil control circuit 17 is connected to the alternate source contacts E to which alternate power is applied when it is desired to transfer the load to the alternate source contacts E, e.g., upon occurrence of a power outage. The normal and alternate source contacts are connected to two phase lines of the normal and alternate sources, respectively, in the preferred embodiment of the invention. However, they may alternatively be connected to one phase contact and a neutral contact.

The phase voltage from the alternate source contacts E is applied to a full wave bridge rectifier 19 including diodes 21, 23, 25, and 27. Voltage level shift resistor 29 connected in parallel with the output terminals of rectifier 19 ensures that the minimum level of the waveform envelope of the full wave rectified voltage is maintained at approximately zero volts.

15 volt D.C. power is provided by applying the rectified voltage output of rectifier 19 across a zener diode 30 which is in series with a diode 31 and resistor 33. A filter capacitor 41 is connected in parallel with the zener diode 30 to minimize ripple.

A transistor 36 has its base connected between a resistor 40 and resistor 34 of a voltage divider 32. In the preferred embodiment of the invention, resistor 40 is a 2-watt resistor having a resistance of 270Kohms and resistor 34 has a resistance of 10Kohms. Hence, when the rectifier 19 is energized, there is a voltage of approximately 0.7 volts at the base of the transistor 36 which maintains the transistor 36 turned on, i.e., the collector-to-emitter junction is conducting. The diode 31 and resistor 33 prevent the filter capacitor 41 from discharging back into resistors 29 and 40.

Connected to the collector of transistor 36, through an RC circuit including 100ohm resistors 42 and 44, and capacitor 46, is an inverter 38. The inverter 38 is a Schmidt trigger circuit which is also connected to receive the 15 volt D.C. output of the zener diode 30 power supply. The control terminal of an insulated gate bipolar transistor (IGBT) 39 is connected to the output terminal of the inverter 38 so that the IGBT 39 is normally conducting.

The solenoid coil 3 is connected in series with the insulated gate bipolar transistor 39. Connected in parallel with the insulated gate bipolar transistor 39 is a metal oxide varistor 37. The voltage output of rectifier 19 is applied across solenoid coil 3 in series with the parallel combination of insulated gate bipolar transistor 39 and metal oxide varistor 37.

There is produced at the output of inverter 38 a signal having a level which is the inverse of the signal level at the collector of the transistor 36. When the transistor 36 is on, the level of the signal at the input of inverter 38 is low and the level of the signal at the output of inverter 38 is high. When the transistor 36 is turned off, the level of the signal at the input of inverter 38 goes high and the level of the signal at the output of inverter 38 goes low.

The insulated gate bipolar transistor 39 is normally conducting due to the high signal on its control terminal which is connected to the output of the inverter 38. When the application of voltage to the coil 3 from the source is interrupted, the emitter-collector junction of the transistor 36 stops conducting, thereby raising the voltage level at the input to the inverter 38. The resultant transition of the output voltage of the inverter 38 to a low state causes the insulated gate bipolar transistor 39 to stop conducting.

The collapse of the field in the solenoid coil 3 upon disconnection of its voltage source induces a current which urges the solenoid plunger 5 toward the plunger stop 15. However, when the insulated gate bipolar transistor 39 stops conducting, the current in the solenoid coil 3 is routed through the metal oxide varistor 37 where it is rapidly dissipated. The solenoid plunger 5 is then free to be returned to its rest position (FIG. 1*c*) by the spring 7 as the armature 9 continues its rotation until full connection of the main contacts 18 with the alternate source E is achieved.

The automatic transfer switch 1 may disconnect a load from a normal source of power and connect it to an alternate source of power as described above or it may disconnect a load from an alternate source of power and connect it to a normal source of power by reversing the above described sequence.

It is to be appreciated that the foregoing is a description of a preferred embodiment of the invention to which variations and modifications may be made without departing from the spirit and scope of the invention. For example, the insulated gate bipolar transistor 39 may be replaced with a field effect transistor (FET) or other bipolar transistor.

What is claimed is:

1. Apparatus for preventing retardation of the switching speed of an automatic transfer switch for selectively disconnecting a load from a first source of power and connecting the load to a second source of power, said automatic transfer switch comprising a set of first source contacts connectable to said first source of power, a set of second source contacts connectable to said second source of power, an armature engageable with said set of first source contacts and said set of second source contacts and rotatable from a first position at which said armature closes said first source contacts and opens said second source contacts to connect the load to the first source of power and disconnect the load from the second source of power, to a second position at which said armature closes said second source contacts to connect the load to the second source of power and opens said first source contacts to disconnect the load from the first source of power, said armature traversing a top dead center position intermediate said first position and said second position, and solenoid means having a pole piece, a coil surrounding said pole piece, and a plunger connected to the armature, said plunger being reciprocable for movement from a rest position distal from said pole piece with said armature at said first position, to an energized position proximate said pole piece with said armature at said top dead center position in response to the application of voltage to said coil for commencing movement of said armature from said first position toward said second position, said plunger moving from said energized position back to said rest position as said armature rotates past said top dead center position to said second position, coil voltage switch means responsive to the position of said armature for interrupting the application of power to said coil when said armature reaches a third position proximate said top dead center position, coil current dissipation means, and coil current shunt means operatively connected to said armature for shunting residual current caused by the collapsing field in said coil to said current dissipation means in response to said armature reaching said third position, whereby the momentum of the armature moves to said second position with movement of said plunger from said energized position back to said rest position free of the opposing force of the collapsing field.

2. An automatic transfer switch according to claim 1 wherein said armature comprises actuator means operatively connected to said coil voltage switch means for actuating said coil voltage switch means as said armature is rotated to a predetermine position corresponding to the approach of said plunger to said pole piece to interrupt the application of voltage to said coil.

3. An automatic transfer switch according to claim 1 wherein said coil current shunt means comprises current switching means having an input terminal, and voltage sensing means having an output terminal operatively connected to said current switching means input terminal and responsive to the interruption of said voltage for actuating said current switching means to direct the flow of coil current through said coil current dissipation means.

4. An automatic transfer switch according to claim 1 wherein said coil current dissipation means comprises a varistor.

5. An automatic transfer switch according to claim 3 wherein said current switching means is connected in parallel with said dissipation means.

6. An automatic transfer switch according to claim 3 wherein said voltage sensing means comprises a transistor having a terminal operatively connected to said second source.

7. A method of preventing residual current in the coil of a solenoid having a plunger connected to an armature of a transfer switch from delaying movement of the armature from a first position to a a second position comprising, connecting the coil in series with a normally closed switch, connecting current dissipation means in parallel with the normally closed switch, sensing the position of the armature, and opening said switch in response to the armature reaching a predetermined position intermediate the first position and second position for routing the residual coil current through the current dissipation means while the armature travels from said predetermined position to said second position.

8. A method of enhancing the speed of actuation of an automatic transfer switch for connecting and disconnecting contacts to transfer a load between a first source of power and a second source of power comprising, linking a plunger of a solenoid to a rotatable actuator means for actuating said automatic transfer switch so that said solenoid plunger moves from a rest position to an energized position and then returns to said rest position as said actuator means moves from a position at which said load is connected to said first source of power, through a top dead center position, to a position at which said load is connected to said second source of power, connecting said solenoid to a source of current to cause said plunger to move from said rest position toward said energized position to cause said actuator means to begin to move from said position at which said load is connected to said first source of power to said position at which said load is connected to said second source of power, disconnecting said solenoid from said source of current when said actuator means is proximate said top dead center position, in response to said actuator means being proximate said top dead center position, shunting the residual current in said solenoid, generated by the collapsing field resulting from said current interruption, to a current dissipation means for enabling the actuator means to continue its rotation to said position at which said load is connected to said second source of power while returning said plunger toward its rest position unhindered by an opposing field in said coil.

9. A method of enhancing the speed of actuation of an automatic transfer switch according to claim 8 wherein said current dissipation means is a varistor.

* * * * *